US006393774B1

(12) United States Patent
Fisher

(10) Patent No.: US 6,393,774 B1
(45) Date of Patent: May 28, 2002

(54) CONSTRUCTION SYSTEM FOR MODULAR APARTMENTS, HOTELS AND THE LIKE

(76) Inventor: John Sergio Fisher, 23310 Aetna St., Woodland Hills, CA (US) 91367

( * ) Notice: Subject to any disclaimer, the term of this patent is extended or adjusted under 35 U.S.C. 154(b) by 0 days.

(21) Appl. No.: 09/207,078

(22) Filed: Dec. 7, 1998

(51) Int. Cl.[7] ..... E04B 1/348; E04H 1/04
(52) U.S. Cl. ..... 52/79.1; 52/236.3
(58) Field of Search ..... 52/236.3, 236.4, 52/236.5, 79.14, 79.2, 79.3, 79.7, 79.8, 79.1

(56) References Cited

U.S. PATENT DOCUMENTS 3,894,373 A * 7/1975 Willingham ..... 52/236.3
4,050,215 A 9/1977 Fisher
4,073,102 A 2/1978 Fisher
4,194,339 A 3/1980 Fisher

* cited by examiner

*Primary Examiner*—Michael Safavi
(74) *Attorney, Agent, or Firm*—Oppenheimer, Wolff & Donnelly LLP

(57) ABSTRACT

A modular construction system uses preformed room-size U-shaped modules and preformed room-size L-shaped modules to form modular housing such as apartments, hotels and the like. The modules may be formed of reinforced concrete. By using U-shaped modules juxtaposed, perpendicular or in parallel (along their edges) with one another, in combination with rotated L-shaped modules, double walls within units may be avoided, thus simplifying construction and reducing costs.

16 Claims, 5 Drawing Sheets

CONSTRUCTION SYSTEM FOR MODULAR APARTMENTS, HOTELS AND THE LIKE

BACKGROUND OF THE INVENTION

This invention is primarily about multi-story, multi-family apartment and hotel pre-finished construction utilizing three-dimensional modules. It also applies to other types of housing and motels as well as to educational, office and community facilities.

When mobile homes are included, approximately two-thirds of the housing produced in the United States today is built in factories using one of three industrialized housing methods or systems or combinations thereof, as follows:

1) skeletal, with components (structural frame with in-filled non-bearing wall panels);

2) panel, with components (structural floor and wall panels);

3) modular or three dimensional, with or without major components (boxes or sections of houses or buildings).

Of these three, modular systems allow the most work and pre-finishing to be done in the factory and therefore the least amount of work in the field, and the present invention relates to a basically modular system. Factory pre-manufacturing and pre-finishing can be best completely realized by the modular systems, and to do so has many advantages. For one thing, factory wages are substantially less than field wages. In addition, a factory can offer better working conditions and can accommodate year-round work. Also, factory work can be under a one-shop-jurisdiction, which can mean more efficient operation because a worker is able to perform more than one trade or task. Finally, assembly line efficiency is greater than on-site work.

Most multi-family modular systems in use today call for the units to be partially or fully pre-finished in the factory so that interior partitions, doors, fixtures, equipment, windows, etc. are installed in the modules in the factory. However, when the full pre-finished modules have been heretofore assembled into a building, assembly has resulted in non-functional redundancy if materials, i.e., double walls or double floors within the same living unit where it is not needed. Cost estimates and actual accounting figures indicate that this redundancy typically adds 100% to the cost of the structure, depending upon the system. Moreover, most of such systems have been based upon a mobile home sectionalized unit which is a very inflexible system for different plan configurations and packing possibilities.

On the other hand, where heretofore attempts have been made to eliminate redundancy, wherein modules are stacked in an alternated or checkerboard pattern in vertical cross-section creating so-called "free spaces," it has been impossible to pre-finish the free spaces at the factory and, as a result, the cost of on-site finishing of, in particular, bathrooms and kitchens has been increased by at least $3.00 to $4.00 per square foot. Furthermore, such systems, when applied to apartments, townhomes and hotels, cannot intrinsically handle the noise attenuation and fire separation requirements at the party walls without going to extra expense and compromising the system. Also, the economic need to have bathroom and kitchens in modules rather than as free spaces, so that they can be preassembled, has been a restraint on the flexibility of such a non-redundant system heretofore available.

In response to the above shortcomings, the inventor in the present case had filed for and received three patents which addressed and solved the above problems. The first ("rotational system") did so by using "U" shaped modules in cross-section which, when stacked, prevented double floors and, by rotating the modules 90 degrees in plan to each other, prevented double walls. There was no redundancy of floors or walls, but yet there was 100% coverage by modules which allowed for full preassembling, particularly for bathrooms and kitchens. It also easily allowed for the needed double walls at party walls. It is described in U.S. Pat. No. 4,050,125 granted Sep. 27, 1977. The second and third patents ("parallel system") solved the same problems and has the same attributes by making the width of the "U" shaped module the width of the living unit as described in U.S. Pat. Nos. 4,073,102 and 4,194,339 granted Feb. 14, 1978 and Mar. 25, 1980, respectively. However, in the actual application of these patents over the last 21 years, certain shortcomings in floor plan design flexibility, particularly for larger living units, appeared in both systems with the result that either there were double walls or the floor plans were compromised in their functional or aesthetic quality. Although the "parallel system" can accommodate a wide variety of plans of any size, it can only do so with relatively high production and handling costs.

SUMMARY OF THE INVENTION

The new invention solves the shortcomings of the previous inventions by combining the stacking geometries of the "rotational" and "parallel" systems while introducing a new element, thus achieving ultimate planning flexibility on a single living unit floor plan without redundancy of walls. The elements can be of any size up to 60 feet in width and up to 14 feet in depth if shipped or of any size at all if produced in an on-site factory. The height of the modular elements will generally range between 8 and 12 feet.

The system of this invention employs two basic elements which are stacked in conjugation or in parallel and which are added to be filled into and embellished, all as called for by the particular plan in which they are employed. These two basic elements are:

1) A first type of rectangular module, having two parallel bearing walls across the width and joined together by a floor. The two opposite ends in the longitudinal direction are either open or have non-bearing walls. From the standpoint of bearing walls, this type of module can be referenced as "U-shaped" or "U-shaped in vertical cross-section."

2) A second type of rectangular module similar to the first module but without one of the bearing walls so that the module consists of one wall and the slab, can be termed "L-shaped" or "L-shaped in cross-section."

The "U" shaped module has no roof ceiling. It can be braced during transportation. When the system of this invention is used on the top story of the building, a horizontal panel is used to top off the assemblage of "U" and "L" shaped modules below.

When these two basic modules are packed together to build the final structure, both the "U" shaped module and the "L" shaped module are stacked in plan in parallel along the open side slab edge and in rotation within the unit on any one floor so as not to have any double walls within the unit. There are double fire and noise separation walls between the units. Moreover, when placing either a "U" or "L" shaped module upon a "U" or "L" shaped module, there are no double floors. This avoidance of redundancy in housing units by mating and placing "U" and "L" shaped modules is a basic principle by which great economy and flexibility can be achieved. When the system is constructed of pre-cast concrete, which would definitely be the case in any structure taller than four to six stories, all the modules are connected together by means of welding steel plates to steel angles that have been cast into the modules. In the case of the floor panel portion of the "L" shaped module connecting to a "U" shaped module, the welded connection is a shear connection.

The fact that the modules can be adjusted to various sizes further increases their flexibility. The modules are pre-finished as much as possible in the factory; exactly how much depends upon the specific manufacturer, the governing codes and union agreements.

The four main objectives of the system of this invention are (1) to maximize the amount of work done in the factory; (2) to minimize the amount of work done in the field; (3) to eliminate non-functional redundancy of materials; and (4) to allow for infinite, economical flexibility of planning possibilities. Certain aspects of the system are (1) the use of "U" and "L" shaped modules on top of one or more levels of the same "U" and "L" shaped modules; (2) the top floor of these modules are topped off with a roof panel, so that in the case of concrete, a much more economical three-sided pre-casting form (mold) can be used instead of a four-sided form; and (3) these "U" shaped modules are arranged in rotated and parallel positions with strategic "L" shaped modules, also in rotation or parallel positions to prevent double walls, to form all the structural walls of a single living unit. Intermediate non-structural or plumbing walls can be constructed of any code-complying material.

The modules of this invention can be easily lifted by forklift, are easily transported by truck, train or ship, and are quickly and easily set in place in the building on-site by crane; they are economical, flexible elements. The simple concept of this system can be organized to conform to any way of living. Although this system is primarily intended for hotels and one-, two-, three-, four- and five-bedroom apartments from one to 24 stories, depending upon the structural material, whether it be concrete, metal, wood, or other molded material, the illustrations contained herein show the principle applied to a specific design for a four-bedroom apartment with details for concrete construction. This unit can be in an apartment building of two to 24 stories high. This system also applies to single story and/or detached dwellings, motels and non-residential applications.

Other objects, features, and advantages of the invention will appear from the following description of preferred embodiments, given as an example and in no way intended to limit the invention to a particular material, a particular height or size of building, to any particular floor plan or exterior design, or to a particular type of living unit.

DESCRIPTION OF PREFERRED EMBODIMENTS

Figure 1:
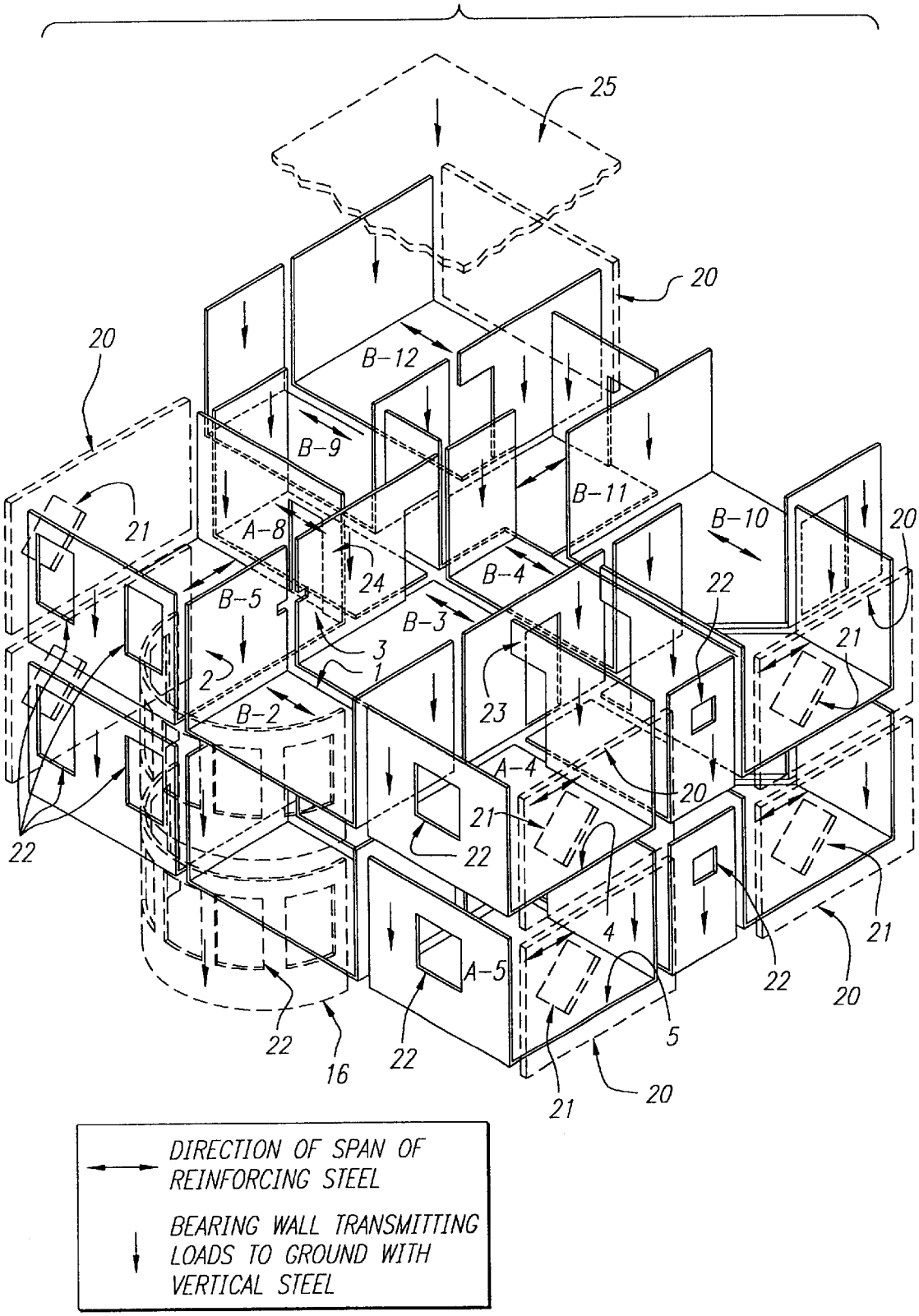
FIG. 1 is a diagrammatic isometric view, partially exploded, showing how a four-bedroom living unit is constructed with the "U" shaped modules arranged in plan in rotation and in parallel along the open side slab edge with strategic "L" shaped modules in accordance with one illustrated embodiment of the present invention. The vertical arrows indicate load bearing walls. The horizontal arrows indicate the direction of the tensile reinforcement in the spanning direction to the bearing walls. The long dashed lines indicate exterior non-floor bearing exterior closure panels.
Figure 2:
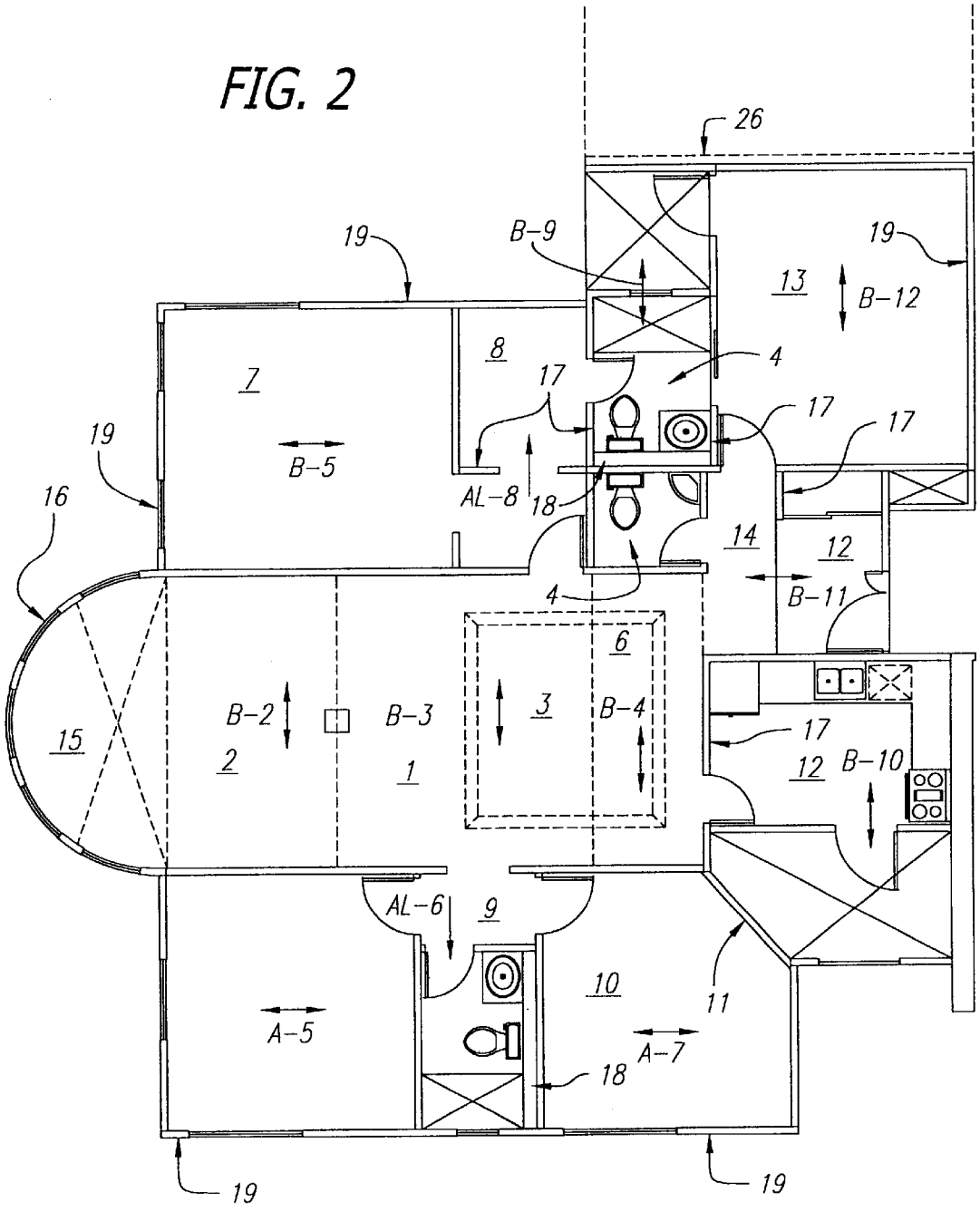
FIG. 2 is the floor plan or horizontal section of the same four-bedroom living unit showing both "U" shaped and "L" shaped modules in rotation (conjugation) or parallel to each other. The direction of the spanning steel in the floor is indicated by the arrows. The kitchen, bathrooms, doors and windows demonstrate some of what can be pre-finished in the modules (both "U" and "L" shaped) at a factory which can be on-site or off-site.

FIGS. 1 and 2 show, in some detail, a four-bedroom plan in which successive units are stacked on top of each other as a portion of either a two-story apartment building or up to a 24-story apartment building. FIG. 1 is an exploded isometric view showing two levels of the same four-bedroom plan that also shows the arrangement of "U" shaped and "L" shaped modules arranged in parallel or in rotation (conjugation).

Figure 4:
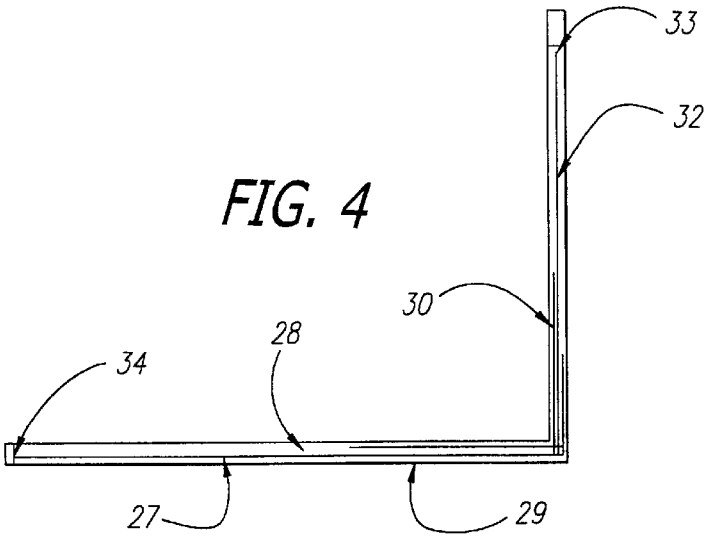
FIG. 4 shows a typical "L" shaped module in vertical cross-section with its reinforcing steel.

FIG. 2 is a floor plan horizontal cross-sectional view of the same four-bedroom apartment plan showing module joints as dashed lines 1. FIG. 2 shows two modules B-2 and B-3 are arranged in parallel along their slab edges and also shows factory pre-finished bathrooms 4 and kitchens 5. The following is a module-to-module description to demonstrate how the modules are arranged so as to prevent double walls as shown in FIG. 1. The "A" modules have a 12-foot clear span as shown in FIG. 3. The "B" modules have a 14-foot clear span. Both the "A" and "B" modules are "U" shaped in vertical cross-section so as to prevent redundancy or double floors as can be seen with modules A-4 stacked upon module A-5 as shown in FIG. 1. AL modules are "L" shaped modules which are 12 feet in clear span as shown in FIG. 4. Module A-5 has a floor area of 12'×12', and is placed in rotation to module B-2 which is 14'×8' in area. Module B-3 is 14'×12' in area and is arranged in parallel along its slab edges to modules B-2 and B-4. Module B-5 is rotated in relation to modules B2 and B3 and also to module AL-8. Module AL-8 is an "L" shaped cross-section module placed in parallel with module B-3.

Figure 6:
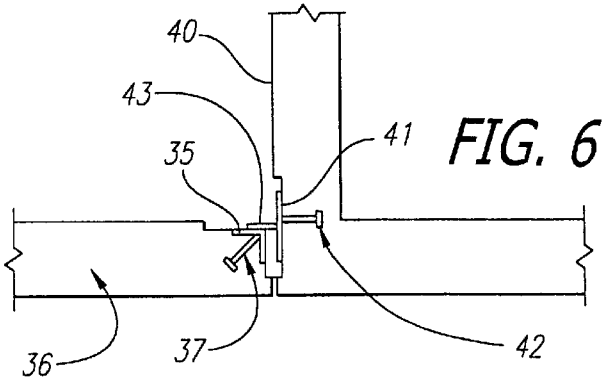
FIG. 6 shows the floor slab connection between two "U" shaped modules placed in rotation (conjugation) to each other in vertical cross-section. The same connection also applies to an "L" shaped module placed in parallel with a "U" shaped module.

The slab on the non-bearing wall side of module AL-8 is connected to the bearing wall of module B-3, as shown in FIG. 6, and a double wall is avoided by securing the free end of the floor of the "L" shaped module AL-8 to module B-3. The same redundancy is avoided at the other side of Module B-3 at module AL-6 which contains a pre-assembled bathroom. Module A7 is rotated in plan to module AL-6 and is also rotated with respect to module B-10, with each of modules A-7 and B-10 having a 45° cut in the module where they are connected at the slabs as per the detail in FIG. 5. Module B-11 is rotated relating to both module B-10 and module B-12. Module B-11 has a comer cut away at 14 in order to nestle into module B-4. Module B-9 is in a parallel relationship along its slab edges to modules AL-8 and B-12. Floor panel 15 is attached to module B-2 and a semicircular vertical panel 16 is provided to complete all the structural modular components of the plan "puzzle" of pieces that achieves a functional, complex plan without any double walls and with small concrete modules that can be economically cast, handled, erected and connected.

The floor panel 15 and modules B-2, B-3 and B-4 arranged in parallel along their slab edges creates a long, wide open space which allows for a generous living-dining room. The bedrooms, baths, kitchen and entry are all self-contained in modules.

Internal non-bearing walls can be of concrete or metal studs and gypsum wall board. Plumbing wall hollow chases 18 are created by 2×8 metal studs and gypsum wall board. Exterior non-bearing walls 19 are of pre-cast concrete and are attached to the module slabs as shown in FIG. 2. They are indicated by long dashed lines 20 in FIG. 1.

The exterior panels can be with or without window openings. Diamond-shaped window openings 21 in the exterior panels are shown in this embodiment. Window openings 22 can also be blocked out in the bearing walls of the modules. In FIG. 1 the rectangular windows in the construction bear reference numeral 22, while the diamond shaped windows in the exterior panels are designated by reference number 21. Doorway blockouts can also occur in the module bearing walls. usually at the end of the bearing wall with a cantilevered header 23 or. within the wall leaving a wall column 24 on the short side near the end of the vertical bearing wall. When the apartment unit is on the top floor of a building, the "U" or "L" shaped module would be topped off with a roof panel 25 or other suitable roof closure.

Although this embodiment demonstrates one specific four-bedroom plan for an apartment or condominium building, this modular placement system can achieve comparable efficient non-redundant plans of any number of bedrooms including singles and hotel suites. As shown at reference numeral 26 in FIG. 2, there usually is a double party wall between adjacent living units for noise control and fire separation.

Figure 3A:
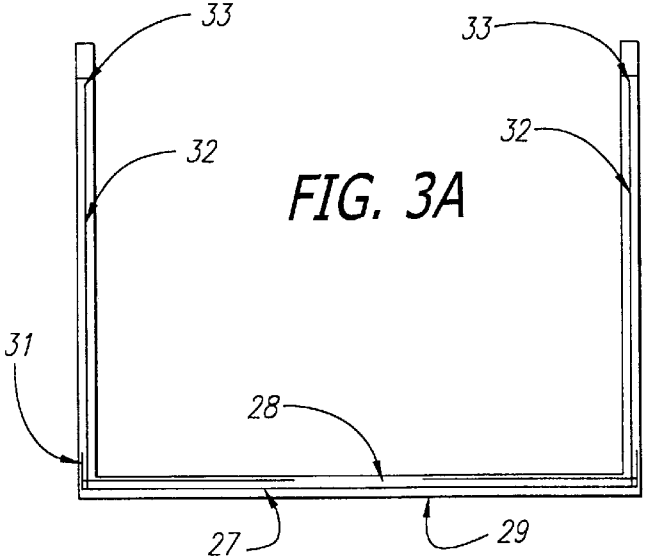
FIGS. 3A and 3B show a typical "U" shaped module in vertical cross-sections with its reinforcing steel.
Figure 3B:
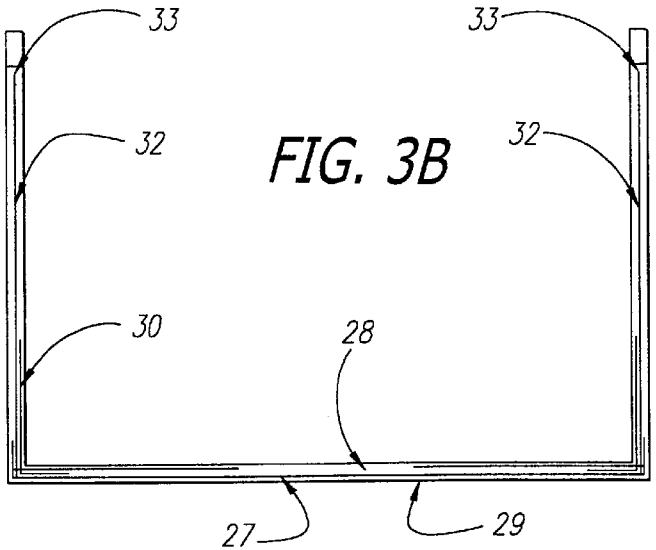

FIGS. 3A and 3B show the welded-wire fabric reinforcing 27 in the "U" shaped modules A and B in cross-section. Reinforcing rods can also be employed. The floor thickness 28 will vary with the length of span, and the thickness of the wall and floor 29 will vary with the height of the building. The tensile fabric may be located ¾" from the bottom of the slab 28. The negative moment steel may climb the bearing wall 30 for a distance of 3 feet in the 14' B module and just six inches in the 12 foot A module 31. The bearing walls have fabric 32 in the middle of the wall topped by a one-half inch reinforcing rod 33.

FIG. 4 shows the welded wire fabric reinforcing 27 in the "L" shaped module. The steel size in the slab and wall is identical to that of FIG. 3B, with a one-half inch reinforcing rod 34 at the end of the slab where there is no wall. There can be occasions when the support of the slab is perpendicular to the bearing wall in which case the spanning steel fabric shall run in both directions.

FIGS. 5–9 show methods of attachment of the modules to each other, to a foundation and to panels. The methods shown in this embodiment indicate the casting in of fastening arrangements such as steel angles or angle plates into the concrete at the factory which are then welded together with the addition of a steel angle or steel plate in the field. This is just one of many techniques for the securing together of the modules. One other method consists of bolting them together at the same locations as the welds by means of hand hole tubes cast into the modules. Another method is to post-tension the modules vertically and for high rises, also horizontally through a conduit cast into the walls (and floors in the case of a high rise) of the modules. A steel rod or cable is then passed through the conduit and pulled in tension with a pneumatic machine with vices placed at each end. Which connection method is used is a function of the height, location, seismic zone, wind conditions, and applicable statutory regulations for the building. The exact location and spacing in the wall and floor for the following welded details is a function of the height, seismic calculations, wind load and prevailing codes. Generally, at least one and preferably two or more fastening plates are used along each mating floor and wall joint.

Figure 5B:
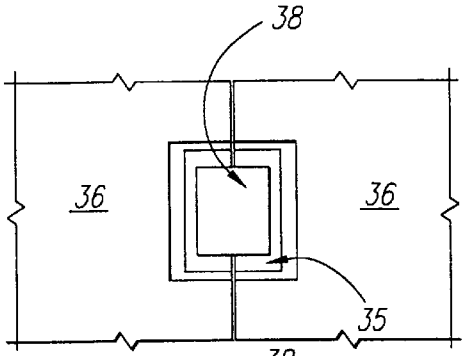
FIG. 5B shows the same connection as in FIG. 5A in a plan view.
Figure 5A:
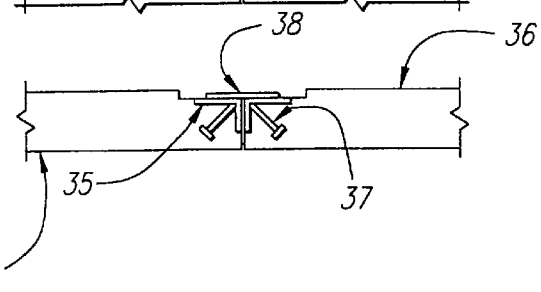
FIG. 5A shows the floor slab connection between two U-shaped modules stacked in parallel in vertical cross-section.

FIGS. 5A and 5B show the connections at both the floor and walls of two modules set in parallel such as modules B-2 and B-3 in FIG. 2. A 6 mm×80 mm×80 mm steel angle 35 which may be 230 mm long is cast into each floor and wall of each module 36. The angle has two 13 mm diameter by 80 mm long steel bolt studs with heads welded at a 45° angle at quarter points 37. After erection of the modules in the field, a steel plate 38 having dimensions of 6 mm×130 mm×200 mm is welded with a 5 mm continuous weld along both long sides of the steel plate 38. FIG. 6 shows the connection of a floor 36 of a module connected to a rotated module 40. The floor has the same angle 35 and stud 37 shown in FIG. 5A. The rotated module wall has a 6 mm×130 mm×230 mm steel plate 41 cast in secured by two 13 mm diameter 80 mm long stud bolts 42 welded perpendicular to the plate at quarter points. A 6 mm×80 mm×200 mm steel plate 43 is welded with a 5 mm continuous weld along the angle in the floor and plate in the wall 40.

In the present specification, certain specific practical dimensions are given. However, it is to be understood that these dimensions may vary with the size of the modules, the height of the building, and other factors, to provide the desired building strength.

Figure 8:
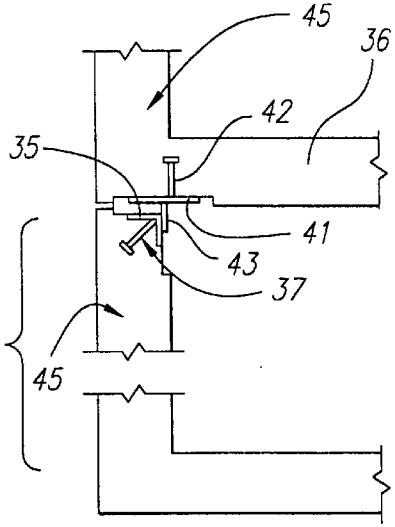
FIG. 8 shows the wall connection at the bearing walls of the modules stacked on top of each other in vertical cross-section. This connection applies to any exterior bearing wall of "U" or "L:" shaped modules stacked in rotation or parallel.
Figure 7:
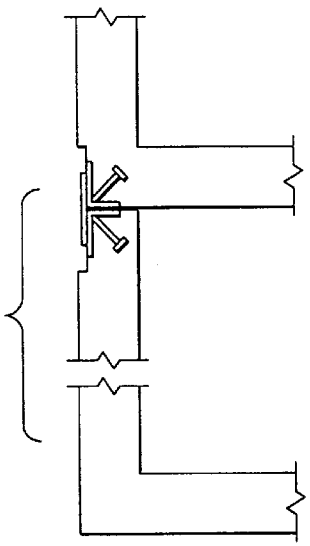
FIG. 7 shows the wall connection at the bearing walls of the modules stacked on top of each other in vertical cross-section. This connection applies to any interior bearing wall of "U" or "L:" shaped modules stacked in rotation or parallel.

FIG. 7 shows the wall connection of two interior modules stacked on top of each other. The steel angles 35, studs 37 and field welded plate 38 and its weld 39 are identical to that shown in FIG. 5A. FIG. 8 shows the wall connection of the exterior wall 45 of two modules stacked on top of each other. This connection should be made from the inside of the module so that scaffolding would not be required on the outside. It consists of the same type of plate 41 and stud 42 as in FIG. 6 cast into the bottom of the module floor 36. The wall has an angle member 35 with a diagonal stud 37 cast into the top of the adjoining wall with a 30 mm gap 46. A plate 43 of the same size as in FIG. 6 is then welded in the field in the same manner as in the previous details.

Figure 9:
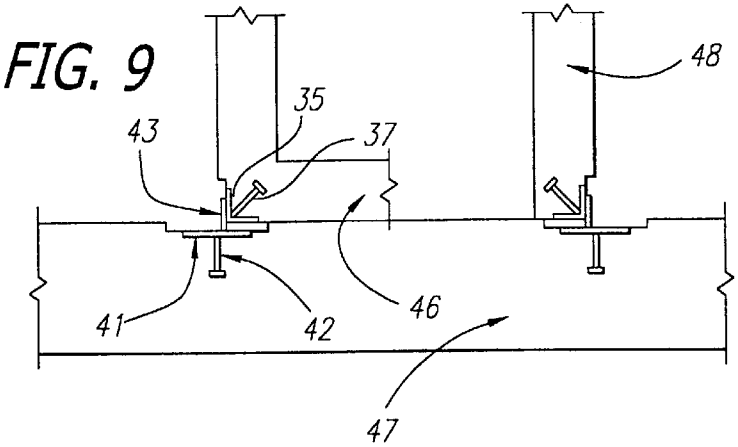
FIG. 9 shows the connection of the bottom floor module and an exterior wall panel to either a podium slab or footing.

FIG. 9 shows the attachment of the bottom floor 46 of modular units either to a foundation wall or the slab 47 of a building podium. The connection of a non-bearing exterior wall panel 48 is also shown. The same type of plate 41 and stud 42 as shown in FIGS. 6 and 8 is cast into the podium slab or footing and is connected to an angle member 35 with diagonal stud 37 cast into the outside corner of the module by a welded steel plate 43. The exterior panel may be secured in an identical manner.

In FIGS. 3–9 various securing arrangements have been disclosed. In practice, the walls and floors of the constructions shown in FIGS. 1, 2 and 10 are all firmly secured together at each joint by a plurality of the fastening arrangements disclosed in FIGS. 5–9, or equivalent high strength securing arrangements.

Figure 10:
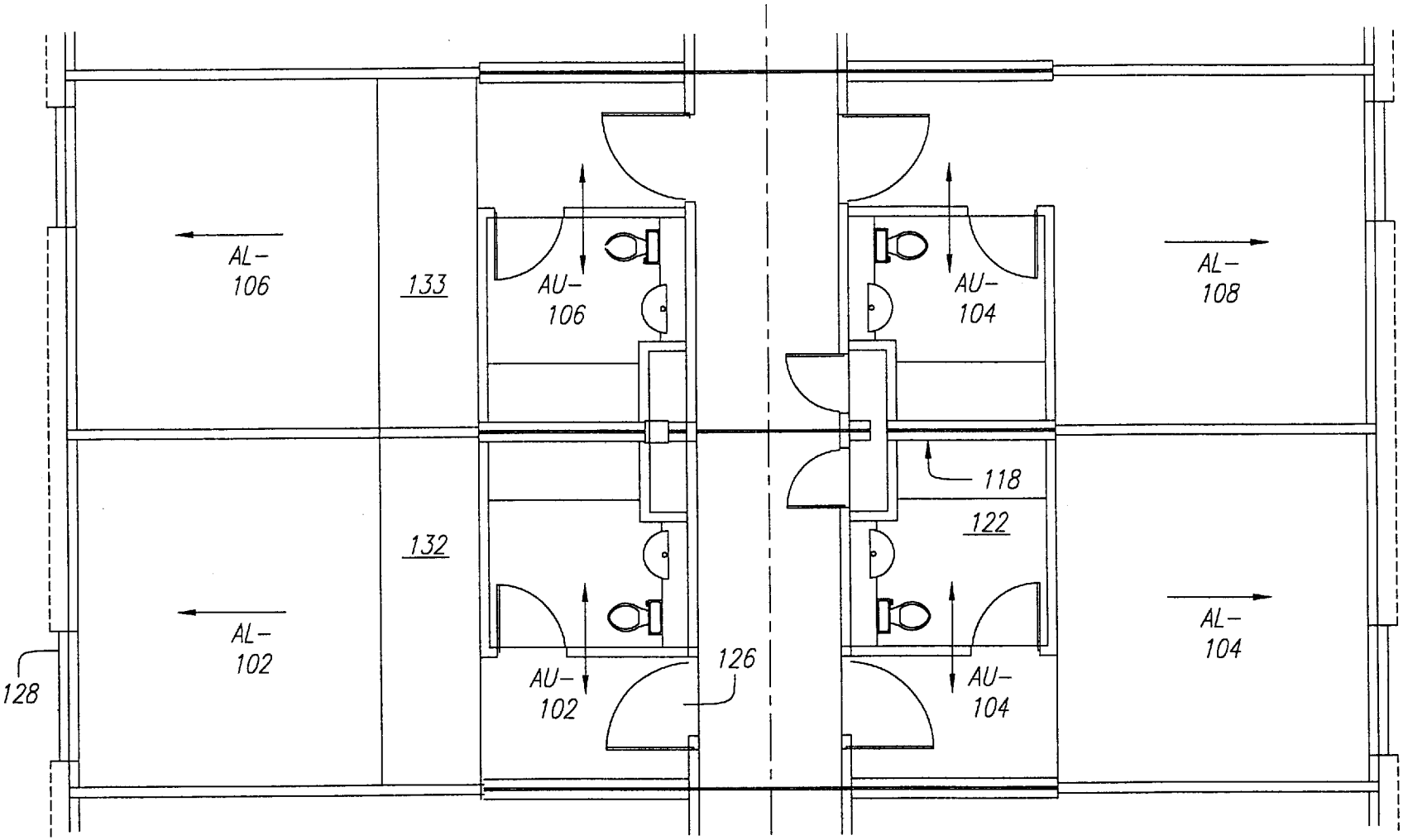
FIG. 10 shows a floor plan of a design illustrating the principles of the invention as applied to a hotel construction room configuration.

Referring now to FIG. 10, it is a schematic floor plan of a hotel configuration using the U-shaped modules and L-shaped modules, and further illustrating the principles of the invention. FIG. 10 shows four hotel rooms 102, 104, 106 and 108. The rooms or suites 102 and 106 are slightly larger than the rooms 104 and 108. The room 104 includes the AL module with a floor area of 12' by 12" and an outer vertical load bearing wall 110. Also extending from the inner edge 112 of module AL- 104 to the centerline 114 of the central corridor, is the AU-104 module, which has a floor area of 12' by 12', and two vertical load bearing walls 116 and 118. Of course, at the ends of the walls 116 and 118 toward the corridor, the vertical walls are fully or partially cut away to provide free corridor access. The preformed bathroom 122 is mounted within the AU-104 module.

Room or suite 108 is configured as the mirror image of room 104, with the outer L-shaped module AL-108 being secured to the inner U-shaped module AU-108.

The rooms 102 and 106 are two feet greater in extent, from door 126 to the outer wall 128, with the floor fill panels 132 and 133 providing the additional area. The rooms 102 and 106 are otherwise substantially the same as room 104, as described above, with each of these rooms including one L-shaped outer module, and a U-shaped module oriented at 90° from the L-shaped module, and with the floor fill panels such as panels 132 and 133 interconnecting these two modules.

Although illustrative embodiments of the present invention have been described in detail hereinabove, it is to be understood that the present invention is not limited to the precise constructions described. Thus, by way of example and not of limitation, the panels need not be of reinforced concrete, but may be formed of other cast or molded materials, including high strength plastics, or may be formed of wood or light gauge metal frame and sheet board panels. Also, instead of the specific module interconnection arrangements shown, the modules may be secured together by any known arrangements, including bolts, cables, or permanent adhesives for specific examples. It is also noted that the factory preformed modules may be braced as they are transported to the building site to avoid damage to the modules. Accordingly, the present invention is not limited to the specific described embodiments.

What is claimed is:

1. A building formed using a modular construction system, including in combination:

a pair of room-size rectangular first U-shaped preformed modules, each having only two vertical bearing planes parallel to each other, each said bearing plane having a plurality of vertical load-bearing structural members joined by a rectangular floor panel having a series of load-carrying spanning means running between said bearing planes, each of said first U-shaped modules having said floor panel terminated at two sides at non-bearing planes, each said module being open on top;

an L-shaped second module having a rectangular floor panel having two longer sides and two shorter sides and a rectangular wall panel extending upwardly from one end of one of the shorter sides of said L-shaped panel, and with the other three sides of said floor panel being free, for attachment to other modules or to non-load bearing walls;

said system including said L-shaped module with a first and a second of said U-shaped modules, one on either side of said L-shaped module, and with one of the two vertical walls of each of said U-shaped modules mounted to one of the two longer sides of the floor panel of said L-shaped module;

an additional plurality of U-shaped modules generally aligned with one another and with their walls aligned and open slab edges parallel to one another, and mounted against one open side of each of said first and second U-shaped modules, and against the shorter side of said L-shaped module which does not have a wall panel secured thereto; and all of said modules being firmly secured together;

whereby the vertically extending bearing walls of said first and second modules are perpendicular to the vertically extending bearing walls of said additional plurality of U-shaped modules.

2. A system as defined in claim 1 wherein:

a plurality of said modules used at each story of a plural-story structure are made by stacking some modules on others, thereby providing upper and lower story modules, each module of each upper story being placed on a module of a lower story with the bearing planes of those modules aligned to carry their load vertically.

3. A system as defined in claim 1 wherein substantially all of said modules are formed of reinforced concrete.

4. A system as defined in claim 1 wherein said L-shaped second module is directly secured to at least one U-shaped module.

5. A system as defined in claim 1 wherein said L-shaped second module is directly secured to at least one U-shaped module which has bearing walls oriented perpendicular to the bearing wall of said L-shaped module.

6. A system as defined in claim 1 wherein the vertical walls of at least some of said U-shaped modules are preformed with door and window openings.

7. A building formed using a modular construction system, including in combination:

a plurality of room-size rectangular first U-shaped modules, each having only two vertical bearing planes parallel to each other, each said bearing plane including vertical load-bearing structural members joined by a rectangular load-bearing floor panel running between said bearing planes, each said module having said floor panel terminated at two sides at non-bearing planes, each said module being open on top;

a plurality of room size, L-shaped second modules, each having a rectangular floor panel and a rectangular wall panel extending upwardly from one end of one of the sides of said L-shaped panel, and with the other three sides of said floor panel being free, for attachment to other modules or to non-load bearing panels;

said system including means for securing the floor panels of a plurality of said L-shaped panels to a plurality of said U-shaped modules;

all of said modules being firmly secured together;

the load-bearing wall panels of some of said modules being oriented perpendicular to the load-bearing wall panels of some of said other modules to which they are secured;

all of said modules being preformed as separate units prior to securing said modules to one another;

said system including additional panels secured to said U-shaped and said L-shaped modules for forming a completed, substantially enclosed structure; and one L-shaped module being located between and secured to two U-shaped modules with the bearing walls of said U-shaped modules extending perpendicular to the orientation of the bearing wall of said L-shaped module.

8. A system as defined in claim 7 herein:

a plurality of said modules used at each story of a plural-story structure are made by stacking some modules on others, thereby providing upper and lower story modules, each module of each upper story being placed on a module of a lower story with the bearing planes of those modules aligned to carry their load vertically.

9. A system as defined in claim 7 wherein substantially all of said modules are formed of reinforced concrete.

10. A system as defined in claim 7 wherein each said L-shaped module is directly secured to at least one U-shaped module.

11. A system as defined in claim 7 wherein the vertical walls of at least some of said U-shaped modules are preformed with door and window openings.

12. A building formed using a modular construction system, including in combination:

a plurality of room-size rectangular first U-shaped modules, each having only two vertical bearing planes parallel to each other, each said bearing plane including vertical load-bearing structural members joined by a rectangular load-bearing floor panel running between said bearing planes, each said module having said floor panel terminated at two sides at non-bearing planes, each said module being open on top;

a plurality of room size, L-shaped second modules, each having a rectangular floor panel and a rectangular wall panel extending upwardly from one end of one of the sides of said L-shaped panel, and with the other three sides of said floor panel being free, for attachment to other modules or to non-load bearing panels;

said system including means for securing the floor panels of a plurality of said L-shaped panels to a plurality of said U-shaped modules;

all of said modules being firmly secured together;

the load-bearing wall panels of some of said modules being oriented perpendicular to the load-bearing wall panels of some of said other modules to which they are secured;

all of said modules being preformed as separate units prior to securing said modules to one another;

said system including additional panels secured to said U-shaped and said L-shaped modules for forming a completed, substantially enclosed structure; and one of the free sides of one of said L-shaped modules being secured to one of the free or open sides of one of said U-shaped modules.

13. A system as defined in claim 12 wherein:

a plurality of said modules used at each story of a plural-story structure are made by stacking some modules on others, thereby providing upper and lower story modules, each module of each upper story being placed on a module of a lower story with the bearing planes of those modules aligned to carry their load vertically.

14. A system as defined in claim 12 wherein substantially all of said modules are formed of reinforced concrete.

15. A system as defined in claim 12 wherein each said L-shaped module is directly secured to at least one U-shaped module.

16. A system as defined in claim 12 wherein the vertical walls of at least some of said U-shaped modules are preformed with door and window openings.

* * * * *